US005924882A

United States Patent [19]

Slazakowski

[11] Patent Number: 5,924,882

[45] Date of Patent: Jul. 20, 1999

[54] FRONT MOUNTING SOCKET FOR A GAS LIGHT TUBE

[76] Inventor: Kenneth A. Slazakowski, 464 Prospect Ave., Pewaukee, Wis. 53072

[21] Appl. No.: 09/002,769

[22] Filed: Jan. 5, 1998

[51] Int. Cl.[6] ..... H01R 33/02

[52] U.S. Cl. ..... 439/244; 439/551; 439/558

[58] Field of Search ..... 439/551, 557, 439/558, 550, 242, 243, 244, 227

[56] References Cited

U.S. PATENT DOCUMENTS

| | | | |
|---|---|---|---|
| 2,235,640 | 3/1941 | Kresge | 439/244 |
| 4,842,535 | 6/1989 | Velke, Sr. et al. | 439/232 |
| 5,063,486 | 11/1991 | Cummings, III et al. | 362/217 |
| 5,348,413 | 9/1994 | Sklar | 403/24 |
| 5,354,208 | 10/1994 | Salaski et al. | 439/230 |
| 5,550,724 | 8/1996 | Moulton | 362/267 |

*Primary Examiner*—Gary F. Paumen
*Assistant Examiner*—Briggitte Hammond
*Attorney, Agent, or Firm*—James A. Wilke

[57] ABSTRACT

The present invention provides a front mounting socket for a gas light tube that can be mounted and removed from a sign substrate without requiring access to the rear portion of a sign enclosure. The front mounting socket is installed and removed from the sign surface substrate by pinching together diametrically positioned retaining clips. Each retaining clip comprises a resilient portion formed by two longitudinal slots in the socket body and is provided with a retaining lip having a raised portion defining a retaining surface that engages the sign surface substrate.

9 Claims, 2 Drawing Sheets

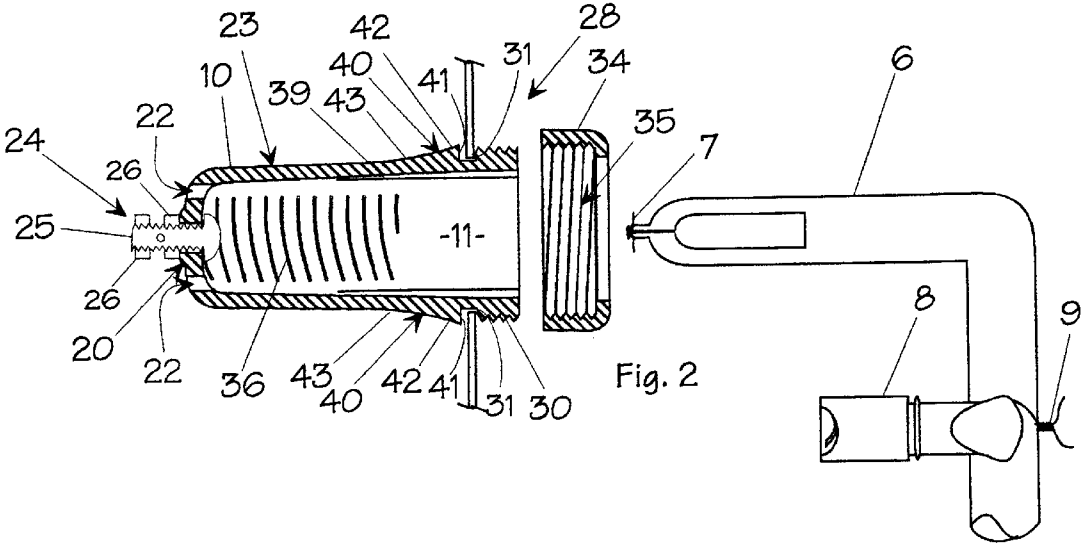
Fig. 2
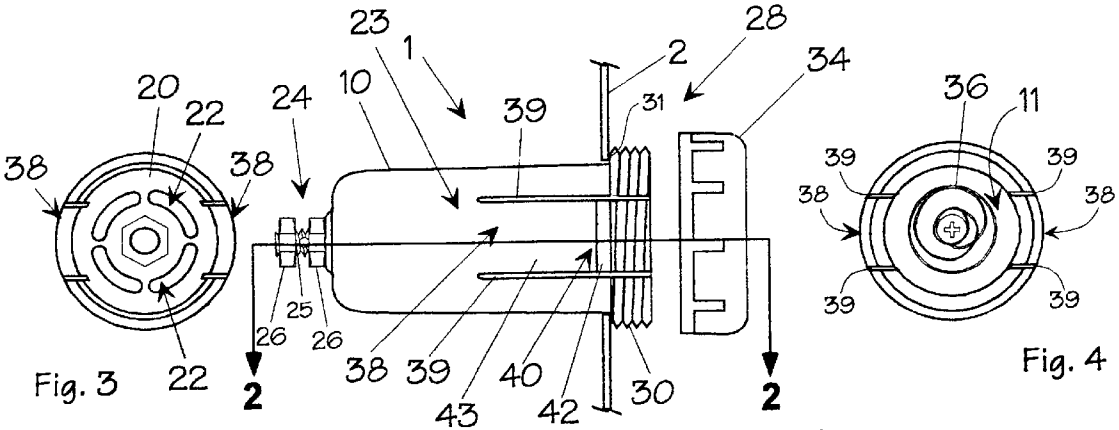
Fig. 1
Fig. 4
Fig. 3

FRONT MOUNTING SOCKET FOR A GAS LIGHT TUBE

FIELD OF THE INVENTION

The present invention relates to gas light tube signs and more particularly to a front mounting socket for a gas light tube.

BACKGROUND OF THE INVENTION

In a gas light tube fixture such as a neon light sign, the neon gas tube must be installed a socket so that the electrical current, usually at a high voltage, can excite the gas which in turn produces the light. The neon gas tube is usually formed into various shapes and can be of various sizes. However, each end of the tube must end in a wire terminal or such to facilitate the electrical connection. The tube, by necessity, must be sealed at each end with only the electrode extending into the sealed tube.

The gas tube, usually made from glass, has the ends generally in a straight configuration to facilitate mounting the tube. A socket mounted in the sign surface substrate accepts the end of the gas tube and provides for the necessary electrical connection. The usual socket only provides for a loose fitting placement of the gas tube in the socket. The gas tube is mounted on several separate mounting stands that not only maintains the gas tube in the socket (at each end the gas tube) but also maintains the gas tube away from the sign surface substrate.

The sockets for the gas tubes must be mounted in the sign surface substrate, at positions generally governed by the length of the gas tube used in the sign. Generally an appropriate aperture is made in the sign surface substrate at a convenient location. The prior art sockets are then installed by inserting the main body of the socket into the aperture and securing the socket by threading a ring on the back side of the sign surface substrate. Such an arrangement requires access to the back side and front side of the sign and its sign surface substrate which is inconvenient and affects the integrity of the sign enclosure. This is especially true in signs located in corners or near ceiling/wall joints. U.S. Pat. No. 4,842,535 discloses a gas tube electrode connector which connects the gas tube to a socket but does not teach the attachment of the socket to a sign. U.S. Pat. No. 5,063,486 discloses a mounting apparatus for a fluorescent lamp holder however this apparatus requires the operator to work behind the sign surface substrate 27 when connecting the attachment socket 40. U.S. Pat. No. 5,354,208 discloses a neon tube connector assembly for J-shaped ends of neon tubes. In this disclosure an enclosure cover must be removed to obtain access to the tube end tip 16 and is limited to J-shaped tubes. U.S. Pat. No. 5,550,724 discloses a housing and cap assembly that facilitates the connection of a neon tube to an electrical cable in two separate, parallel cylinders. This patent does not disclose how the housing and cap assembly is installed in a sign enclosure. U.S. Pat. No. 5,348,413 disclosures a conduit sealing assembly for a neon tube. This assemble facilitates connecting the neon tube to the electrical cable but the cover for the tube/electrical connection is a downward facing glass cup 28. The conduit connection to the sign housing is done with a screw rings 42 and a nut 54 on a sleeve 36.

Existing gas light tubes, such as neon light tubes, have glass sockets which use a rear mounted metal retaining ring threaded on the glass socket. Such socket is easily broken by dropping or over tightening the retaining ring and requires access to the back of the sign surface substrate.

SUMMARY OF THE INVENTION

The present invention provides a front mounting socket for a gas light tube that can be mounted and removed from a sign substrate without requiring access to the rear portion of a sign enclosure. The front mounting socket having a top portion with mounting threads a part of which form an annular mounting surface, a mid portion, and a bottom portion having a wire terminal with said wire terminal in communication with a cavity in the socket body. In the cavity is an electrode contact spring retained in place by a portion of the wire terminal. The socket body is secured to the sign surface substrate by a retainer ring threadedly mounted to the mounting threads of the socket body. The socket body can be installed and removed from the sign surface substrate aperture by pinching diametrically positioned retaining clips. Each retaining clips comprises a resilient portion formed by two longitudinal slots in the socket body in the top portion of the socket body and is provided with a retaining lip having a raised portion defining a retaining surface that engages the sign surface substrate. When the retainer ring is threadedly mated to the socket body and tightened, the retainer ring abuts the sign substrate surface, thereby interposing the sign surface substrate between the mounting surface of the front mounting socket and the retainer ring.

An important feature of one embodiment of the present invention is that the retaining clip and the retaining lip is integral with the socket body.

An important feature of one embodiment of the present invention is that a retainer means is a spring clip that engages the top portion of the socket body and secures the socket body to the sign surface substrate. This arrangement interposes the sign surface substrate between the retaining surface and the retainer means.

Another feature of the present invention is that drain holes in the bottom portion of the socket body can be covered with the covers selectively removable by the operator.

The present invention eliminates the need for a door or removable panels in sign housings to access terminals, retaining rings or wiring from the interior of sign enclosures. All work for connecting the wiring to a gas tube socket or installing and removing the socket can be accomplished from the front or outside of the sign enclosure.

The present invention can be molded in or machined from a suitable, dielectric material such as plastic, nylon, or the like, rated for the required temperatures, and virtually unbreakable.

Additionally, the present invention is light weight, has few parts, the same material is used for the socket body and the retainer ring, and can withstand rough handling.

Other principal features and advantages of the invention will become apparent to those skilled in the art upon review of the following drawings, the detailed description and the appended claims.

BRIEF DESCRIPTION OF DRAWINGS

FIG. 1 is side view of the Front Mounting Socket installed in an aperture of a sign surface substrate with the retainer ring aligned to engage the mounting threads.

FIG. 2 is a section view of the Front Mounting Socket through the section 2—2 in FIG. 1 and illustrates a gas light tube.

FIG. 3 is an end view of the bottom portion of the Front Mounting Socket.

FIG. 4 is an end view of the top portion of the Front Mounting Socket without the Retainer Ring.

Figure 6:
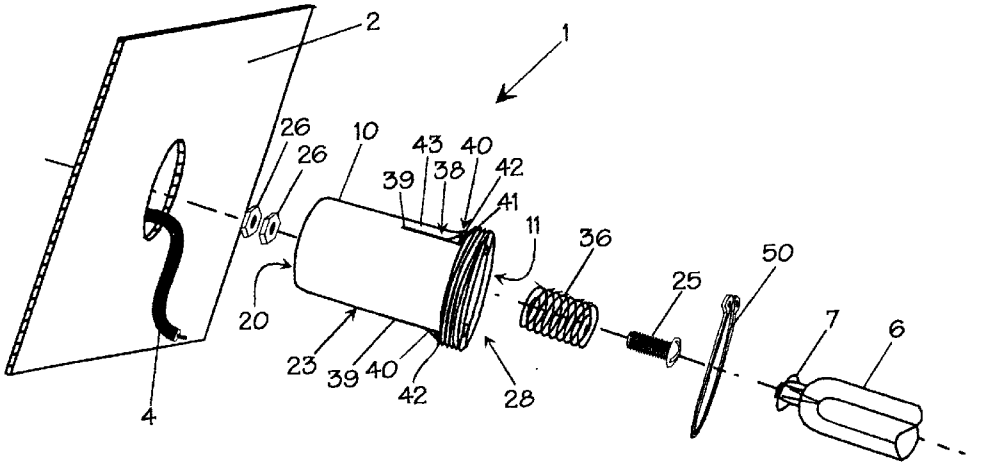
FIG. 6 is a perspective, exploded view of the Front Mounting Socket illustrating the spring clip type retainer means embodiment.

Before explaining the preferred embodiment of the invention in detail, it is to be understood that the invention is not limited in its application to the details of construction and the arrangement of the components set forth in the following description as illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF PREFERRED EMBODIMENT

Figure 5:
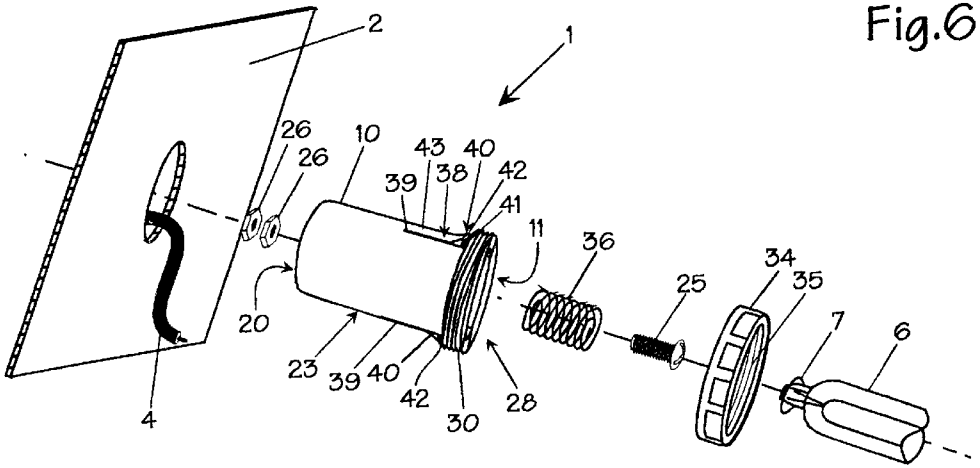
FIG. 5 is a perspective, exploded view of the Front Mounting Socket illustrating the retainer ring embodiment.

Referring now to FIGS. 1, 2 and 5 there is shown a front mounting socket 1 for a gas light tube 6 which socket 1 is mounted in an aperture 3 of a sign surface substrate 2. A socket body 10 having a top portion 28 with mounting threads 30 which threads 30 form an annular mounting surface 31, a mid portion 23 and a bottom portion 20 comprise the principal item of the present invention.

The bottom portion 20 of the socket body 10 is provided with a plurality of drain holes 22 and a centrally located wire terminal 24 in a terminal hole 27. The socket body 10 is an elongated, closed end tube with a central cavity 11. The drain holes 22 and the terminal hole 27 are in communication with the cavity. The drain holes 22 allow moisture, which may accumulate in the cavity 11 of the socket body 10, to exit said socket 10. Since some gas light tube signs are exposed to moisture in outdoor signs, such drain holes 22 are advantageous. The drain holes 22 can best be seen in FIG. 3. The illustrated drain holes are arcuate slots but they can be in an convenient shape, configuration and number. In some applications, the drain holes 22 may not be necessary so the socket body 10 will not have drain holes in communication with the cavity 11. One embodiment of the present invention provides removable covers over the drain holes 22, which covers may selectively be removed by the operator. Such covers can be of the "knockout" type.

The socket body can be made of a dielectric material which is electrically insulating and resilient. The wire terminal 24 illustrated consists of a bolt 25 secured in the terminal hole 27 of the socket body 10 by a nut 26. The bolt 25 is in communication with the cavity 11 and secures an electrode contact spring 36 in the cavity 11 of the socket body 10. A second nut 26 secures a wire 4 to the wire terminal 24. The wire 4 provides an electrical connection to the front mounting socket 1 to power the gas light tube 6. A gas light tube 6 is provided with an electrode contact 7 at each of its ends (See FIGS. 2 and 5). The electrode contact 7 mechanically contacts the electrode contact spring 36 when the gas light tube 6 is inserted into the socket body 10 of the front mounting socket 1 of the present invention.

A retainer ring 34 having internal threads 35 corresponding to the mounting threads 30 on the socket body 10 is threadedly mated to the mounting threads 30 of the socket body 10 and secures the socket body 10 of the sign surface substrate 2. The sign surface substrate 2 has an aperture 3 into which the socket body 10 is inserted.

The socket body is provided with two diametrically positioned retaining clips 38 with each retaining clip 38 comprising a resilient portion formed by two longitudinal, parallel slots 39 in the socket body 10 extending through the mounting threads 30 in the top portion 28 of the socket body 10 to the mid-portion 23 of the socket body 10 and with each slot 39 in communication with the cavity 11 in the socket body 10. Each retaining clip 38 is provided with a retaining lip 40 near the top portion 28 of the socket body 10, with said retaining lip 40 having a raised portion 42 defining a retaining surface 41 that engages the sign surface substrate 2 when the socket body 10 is inserted into the aperture 3. Another embodiment of the present invention provides a retaining clip 38 and retaining lip 40 that is integral with the socket body 10. The portion of the retaining clip 38 near the mid portion 23 of the socket body 10 is resilient 43 and allows movement of the two retaining clips 38 in a plane parallel to the longitudinal axis of the socket body.

After connecting an electrical wire 4 to the wire terminal 24, the socket body 10 is installed in a gas light tube sign. The socket body 10 is inserted in an aperture 3 of the sign surface substrate 2 until the annular mounting surface 31, juxtaposed to the threads portion 30 on the socket 10, abuts the sign surface substrate 2. During the insertion procedure, the edge of the aperture forces the retaining clips 38 into the cavity 11 as the aperture edge slides along the raised portion 42 of the retaining lip 40 on each retaining clip 38. The resilient portion 43 allows each retaining clip 38 to move into the cavity 11 until the raised portion 42 passes the aperture edge whereby the aperture edge is between the retaining surface 41 of the raised portion 42 and the mounting surface 31. An operator could also pinch together the two retaining clips 38 during the insertion procedure. The retainer ring 34 is then threadedly attached to the socket body 10 mounting threads 30 and tightened until the retainer ring 34 abuts the sign surface substrate 2 thereby interposing the sign surface substrate 2 between the mounting surface 31 of the front mounting socket 1 and the retainer ring 34 which secured the said socket 10 to the sign.

Another embodiment of the present invention provides a socket body 10 having a top portion 28 and a bottom portion 20. The bottom portion 20 has a wire terminal 24 in communication with a cavity 11 in the socket body 10 similar to the previously described embodiment. The top portion 28 of the present embodiment has a retaining surface 41 that contacts the sign surface when the socket body 10 is pulled toward the sign surface substrate 2 and secured in place by the placement of a retainer means, such as a spring clip 50, on the socket body 10. The spring clip may be of the split ring type and engages the mounting threads 30 on the top portion 28 of the socket body 10. The socket body 10 may also be provided with an annular groove in the socket body 10 top portion 28 into which the spring clip 50 is placed and engages the socket body 10.

The gas light tube is usually an elongated glass tube containing a gas such as neon. Each end of the glass tube has an electrode contact 7. The glass tube is supported above the sign surface substrate 2 by several tube supports. The glass tube is inserted into the cavity 11 of the socket body 10 and makes mechanical and electrical contact with the electrode contact spring 36. The glass tube is maintained in the socket body 10 by tube retaining wires attached to the tube supports in a conventional manner.

Thus, it should be apparent that there has been provided in accordance with the present invention a front mounting socket for a gas light tube sign and a method for installing and a method for removing a front mounting socket in a sign that satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. A front mounting socket for a gas light tube, which socket is mounted in an aperture in a sign surface substrate, said socket comprising:

a socket body having a top portion with mounting threads a part of which form a mounting surface, a mid portion, and a bottom portion having a wire terminal with said wire terminal in communication with a cavity in the socket body, said socket body further provided with two diametrically positioned retaining clips with each retaining clip comprising a resilient portion formed by two longitudinal parallel slots in the socket body extending through the mounting threads in the top portion of the socket body to the mid-portion of the socket body and with the slots in communication with the cavity and a retaining lip near the top portion of the socket body with said retaining lip having a raised portion defining a retaining surface that engages the sign surface substrate and, an electrode contact spring positioned in the cavity of the socket body and in electrical contact with the wire terminal, and a retainer ring having internal threads corresponding to the threads on the socket body, said retainer ring threadedly mated to the mounting threads of the socket body and securing the socket body to the sign surface substrate.

2. The front mounting socket of claim 1 wherein the socket body comprises a dielectric member.

3. The front mounting socket of claim 1 wherein each retaining clip and retaining lip is integral with the socket body.

4. The front mounting socket of claim 1 wherein the bottom portion of the socket body is provided with a plurality of drain holes.

5. The front mounting socket of claim 4 wherein the bottom portion of the socket body is provided with a plurality of removable covers for the drain holes.

6. A method for securing a front mounting socket in a sign having a sign surface substrate with said substrate having at least one aperture, said method comprising:

connecting an electrical wire to a wire terminal on a front mounting socket, said socket body further provided with two diametrically positioned retaining clips with each retaining clip comprising a resilient portion formed by two longitudinal parallel slots in the socket body extending through the mounting threads in the top portion of the socket body to the mid-portion of the socket body and with the slots in communication with the cavity and a retaining lip near the top portion of the socket body with said retaining lip having a raised portion defining a retaining surface that engages the sign surface substrate, inserting the front mounting socket into the aperture in the sign surface substrate until the retaining surface, juxtaposed to a thread portion on the socket, abuts the sign surface substrate, mount a retainer ring having internal threads on the threads of the front mounting socket, and tightening the retainer ring until the retaining ring abuts the sign substrate surface, thereby interposing the sign surface substrate between the retaining surface of the front mounting socket and the retainer ring which secures said socket to the sign.

7. The method of claim 6 including the step of removing a cover from a drain hole in the front mounting socket.

8. A front mounting socket for a gas light tube, which socket is mounted in an aperture in a sign surface substrate, said socket comprising:

a socket body having a top portion a part of which forms a retaining surface and a bottom portion having a wire terminal with said wire terminal in communication with a cavity in the socket body, said socket body further provided with two diametrically positioned retaining clips with each retaining clip comprising a resilient portion formed by two longitudinal parallel slots in the socket body extending through the mounting threads in the top portion of the socket body to the mid-portion of the socket body and with the slots in communication with the cavity and a retaining lip near the top portion of the socket body with said retaining lip having a raised portion defining a retaining surface that engages the sign surface substrate and, an electrode contact spring positioned in the cavity of the socket body and in electrical contact with the wire terminal, and a retainer means that engages the top portion of the socket body and secures the socket body to the sign surface substrate thereby interposing the sign surface substrate between the retaining surface and the retainer means.

9. The front mounting socket of claim 8 wherein the retainer means is a spring clip.

* * * * *